United States Patent [19]

Davidson

[11] 4,034,552

[45] July 12, 1977

[54] WRIST WATCH

[76] Inventor: Charles Davidson, 35 Old Post Road N., Croton-on-Hudson, N.Y. 10520

[21] Appl. No.: 673,597

[22] Filed: Apr. 5, 1976

[51] Int. Cl.[2] ..... G04B 37/00; G04B 39/00

[52] U.S. Cl. ..... 58/88 R; 58/55; 58/91; 63/3; 63/21; D10/32; D10/38

[58] Field of Search ..... 58/88 R, 88 G, 89, 91, 58/55, 100, 104; 63/3, 21; 248/114; D10/32, 38

[56] References Cited

FOREIGN PATENT DOCUMENTS 801,389 1/1936 France ..... 63/3

*Primary Examiner*—Stanley J. Witkowski

[57] ABSTRACT

A wrist watch comprising a case having holes therethrough and a cavity therein adapted to receive a watch movement; first and second segments each having a selected outer contour and a selected inner contour; a wrist band having holes therethrough in alignment with the holes in the case; the first and second segments have threaded cavities in alignment with the holes in the case and the holes in the wrist band; and screw means for clamping together the first and second segments, the wrist band and the case; and wherein the screw means includes threaded screws passing through the holes in the case, the holes in the wrist band and into the threaded cavities in the first and second segments.

6 Claims, 5 Drawing Figures

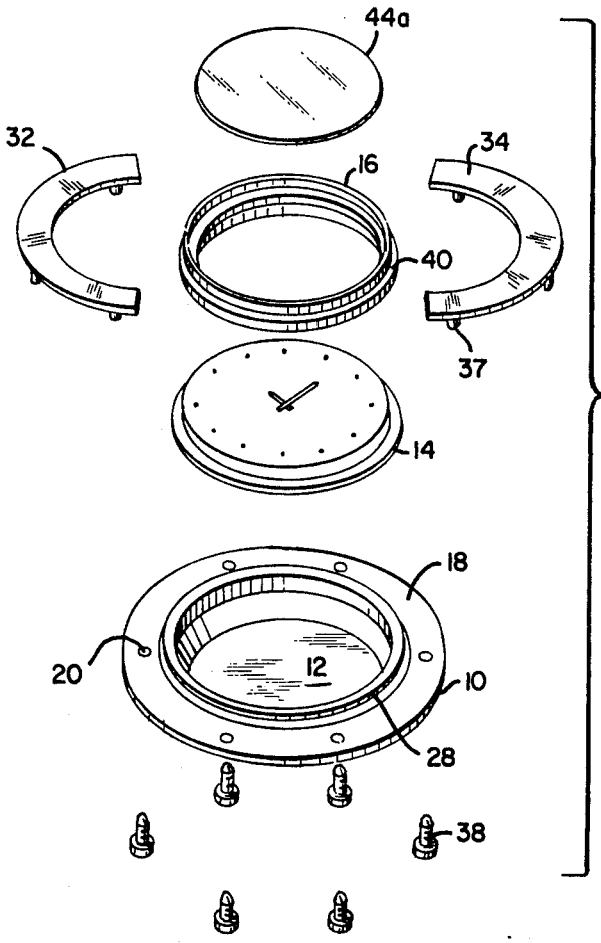
FIG. 1
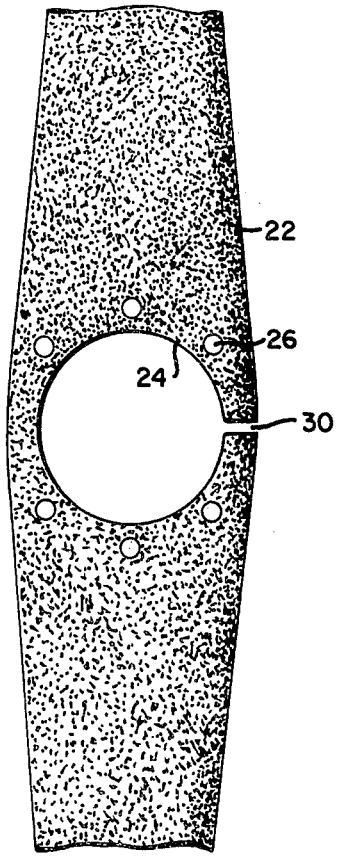
FIG. 3
FIG. 2
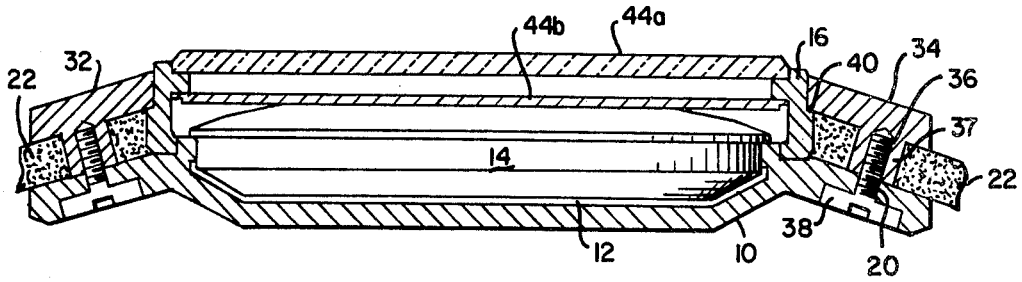

WRIST WATCH

This invention is directed to wrist watches and in particular to improved rugged sport watches having desired metal components of different materials which economically can not be welded together.

It is a known fact that gold and stainless steel are attractive exposed components for watches, especially sport watches, but that they are not economically feasible to weld together.

It is also known that sport wrist watches are subject to large stresses and shocks which often shear the push pins normally used in the prior art to hold the wrist band to the watch case. Breakage of one push pin usually results in either a loss of the watch, or at least physical damage to the watch case as it falls to the floor or pavement.

It is an object of the invention to provide an improved sport wrist watch having exposed components of different difficult to weld metals.

Another object of the invention is to provide a more rugged and more secure manner of securing a wrist band to a sport wrist watch.

Other objects and features of the present invention will be set forth or apparent in the following description and claims and illustrated in the accompanying drawings which disclose by way of example and not by way of limitations, in a limited number of embodiments, the principal of the invention and implementations of the inventive concept.

In the drawings, like reference numbers designate like components in the several views.

FIG. 1 is an exploded perspective view of one embodiment of a wrist watch according to the invention;

FIG. 2 is a cross sectional view of the assembled watch of FIG. 1;

FIG. 3 is a plan view of a wrist band according to the invention;

Figure 4:
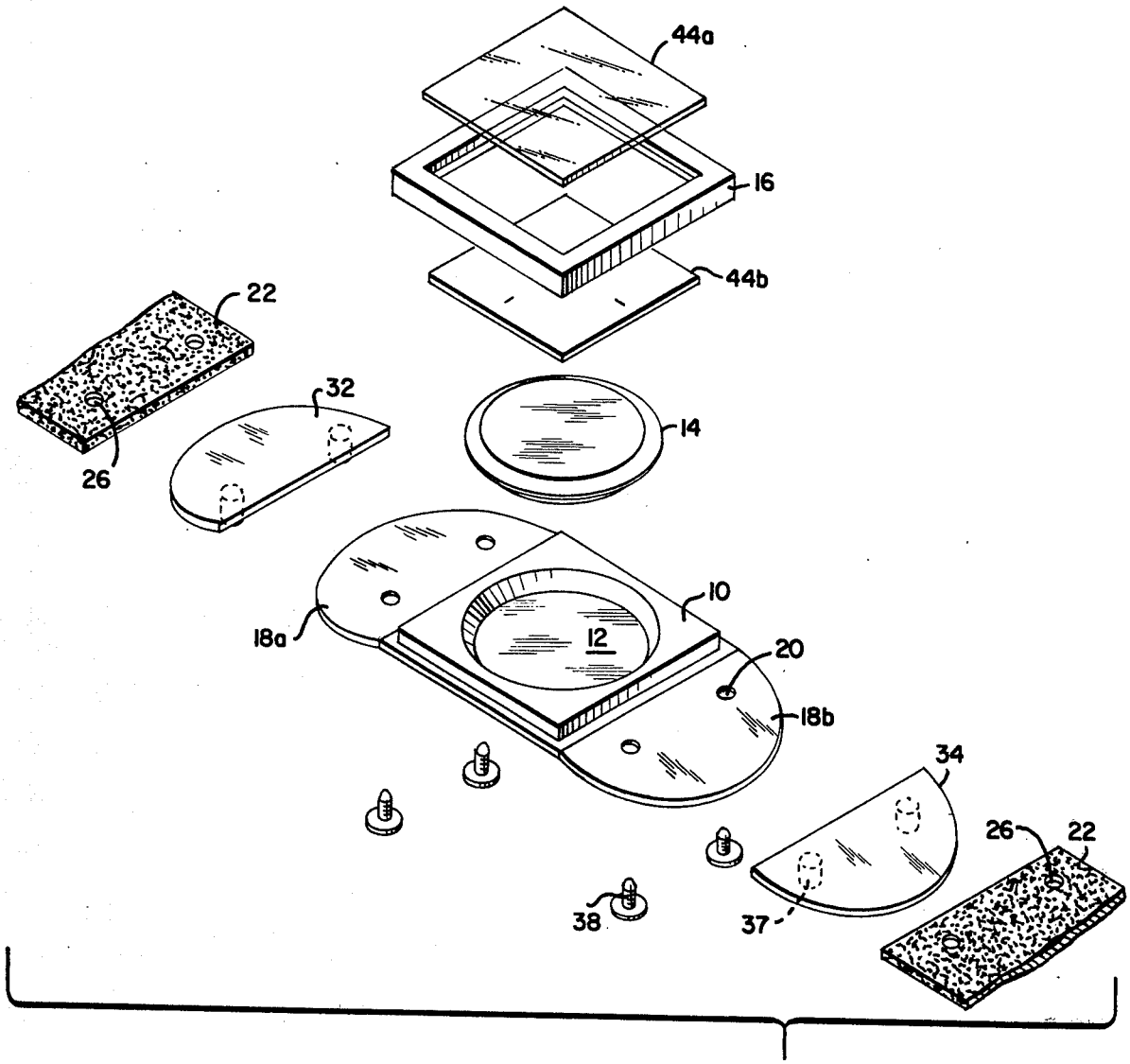
FIG. 4 is an exploded perspective view of another embodiment of a wrist watch according to the invention.

As shown in FIGS. 1 and 2, a watch case 10 has a cavity 12 to receive a watch movement 14. A round bezel 16 engages the case 10 and surrounds the watch movement.

The case 10 has an outer rim 18 with a plurality of holes 20 therethrough.

As shown in FIG. 3, a wrist band 22 has an opening 24 and a plurality of holes 26 in alignment with the holes 20 in rim 18 of case 10. As shown in FIG. 1, the case 10 has an edge 28 protruding from the rim 18. The wrist band 22 is positioned so that the circumference of its opening 24 engages the edge 28 and holes 26 are aligned with the holes 20 in rim 18. A slot 30 in the wrist band facilitates the fitting of the band 22 to the case 20.

Segments 32, 34 are provided to clamp the wrist band 22 to the rim 18 of the case 10. The segments 32, 34 have a selected inner and outer contour. As shown in FIG. 1, the selective inner and outer contours of the half circular rim segments 32, 34 are circular of different radii. As shown in FIG. 4, the selected inner and outer contours of each half circular plate 32, 34 are straight line and half circular, respectively.

Half circular rim segments 32, 34 have a plurality of threaded cavities 36 in bosses 37 aligned with the holes 20 in rim 18 and holes 26 in wrist band 22. After the segments 32, 34 are positioned and aligned, a plurality of screws 38 are inserted through the holes 20 in rim 18, through the holes 26 in band 22 and screwed into the threaded cavities 36 of segments 32, 34. As shown in FIG. 2 the bezel 16 has a ledge 40 which is engaged by the segments 32, 34. By tightening the screws 38, the band 22, the bezel 16 and the watch movement 14 are secured to the case 10 in a very rugged manner.

As shown in FIG. 2, the bosses 37 have a selected height for the threaded cavities 36 to prevent squashing of the band 22 in the event of overtightening of the screws 38.

In a customary manner, one or two crystals 44*a*, 44*b* are secured by the bezel 16.

Figure 5:
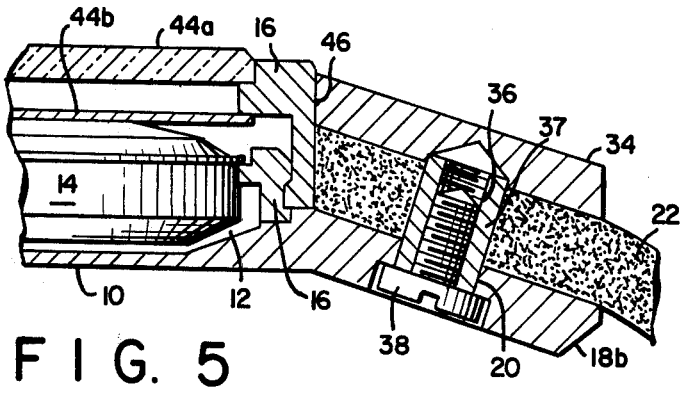
FIG. 5 is a cross-sectional view of the assembled watch of FIG. 4.

FIGS. 4 and 5 illustrate another embodiment of the invention wherein the case 10 and bezel 16 are square and the case wings 18*a*, 18*b* and segments plates 32, 34 each have a half circular contour. Also the wrist band 22 is divided in half, the two cut edges butting up against the square case 10.

Other embodiments of the invention (not shown) have the heads of screws 18 exposed from the top view of the watches of FIGS. 2 and 5. This is accomplished by placing the holes 20 in the segments 32, 34 and the threaded bosses 37 on the rim 18 of FIG. 1, or the case wings 18*a*, 18*b* of FIG. 4.

In a customary manner, two crystals 44*a*, 44*b* are fitted in the bezel 16. A sloping face 46 of segment 34 will cam the bezel to a secure relationship with case 10 when screws 38 are selectively tightened.

According to the invention, the components 32, 34 and 10 can be of different metals which can not be easily welded together. For instance, segment 32 can be gold, segment 34 can be stainless steel and the case 10 can be either stainless steel or gold.

The watches shown in FIGS. 1 to 5 can withstand a great deal of stress, strain and shock on the wrist of an active sportsman without fear of breaking away the wrist band 22 from the watch case.

While there has been described and pointed out the fundamental novel features of the invention as applied to preferred embodiments, it will be understood that various omissions and substitutes and changes in the form and details of the devices illustrated and its operation may be made by those skilled in the art, without departing from the spirit of the invention. It is the intention, therefore, to be limited only as indicated by the scope of the following claims.

What I claim is:

1. A wrist watch comprising a case having holes therethrough and a cavity therein adapted to receive a watch movement; first and second segments each having a selected outer contour and a selected inner contour; a wrist band having holes therethrough in alignment with the holes in said case; said first and second segments have threaded cavities in alignment with the holes in said case and the holes in said wrist band; and screw means for clamping together said first and second segments, said wrist band and said case; and wherein said screw means includes threaded screws passing through the holes in said case, the holes in said wrist band and into the threaded cavities in said first and second segments.

2. A wrist watch according to claim 1 wherein said first and second segments are of different materials.

3. A wrist watch according to claim 2 wherein said case is of different material than at least one of said first and second segments.

4. A wrist watch according to claim 1 including a bezel which is clamped between said case and said first and second segments by said screw means.

5. A wrist watch according to claim 1 including a round bezel and wherein each of said first and second segments is shaped as a half circular rim.

6. A wrist watch according to claim 1 including a rectangular bezel and wherein each of said first and second segments is shaped as a half circular plate.

* * * * *